US007887001B2

(12) United States Patent
Yoon et al.

(10) Patent No.: US 7,887,001 B2
(45) Date of Patent: Feb. 15, 2011

(54) UNWINDING MACHINE FOR ELASTROMERIC FIBER USING OETO METHOD

(75) Inventors: Keon Yong Yoon, Anyang-si (KR); Yeon Soo Kang, Anyang-si (KR); Seung Won Seo, Gunpo-si (KR)

(73) Assignee: Hyosung Corporation (KR)

( * ) Notice: Subject to any disclaimer, the term of this patent is extended or adjusted under 35 U.S.C. 154(b) by 351 days.

(21) Appl. No.: 11/814,969

(22) PCT Filed: May 15, 2006

(86) PCT No.: PCT/KR2006/001807

§ 371 (c)(1),
(2), (4) Date: Jul. 27, 2007

(87) PCT Pub. No.: WO2007/064064

PCT Pub. Date: Jun. 7, 2007

(65) Prior Publication Data

US 2008/0135670 A1 Jun. 12, 2008

(30) Foreign Application Priority Data

Dec. 2, 2005 (KR) ..... 10-2005-0116846

(51) Int. Cl.
*B65H 49/10* (2006.01)
*B65H 49/16* (2006.01)
*D02H 1/00* (2006.01)
*D01H 9/00* (2006.01)

(52) U.S. Cl. ..... 242/131; 242/128; 242/147 M; 242/418; 242/419.3; 242/551; 242/564.4; 242/593

(58) Field of Classification Search ..... 242/410, 242/416, 418, 419, 419.3, 418.1, 419.1, 551, 242/563, 564.3, 566, 593, 128, 131, 131.1, 242/147 M, 150 M, 157 R
See application file for complete search history.

(56) References Cited

U.S. PATENT DOCUMENTS

| | | | | | |
|---|---|---|---|---|---|
| 4,296,174 | A * | 10/1981 | Hanzel et al. | ..... | 428/389 |
| 4,471,917 | A * | 9/1984 | Whisnant | ..... | 242/419 |
| 6,126,102 | A * | 10/2000 | Mycielski et al. | ..... | 242/128 |
| 6,232,374 | B1 * | 5/2001 | Liu et al. | ..... | 524/210 |
| 6,403,712 | B1 * | 6/2002 | Ito et al. | ..... | 525/131 |
| 2003/0006331 | A1 * | 1/2003 | Heaney et al. | ..... | 242/131 |

* cited by examiner

*Primary Examiner*—William E Dondero
(74) *Attorney, Agent, or Firm*—Baker & Hostetler LLP

(57) ABSTRACT

An elastomeric fiber can be easily unwound from a package by way of using an OETO unwinding device which comprises a fiber package, a standby package and a static guide such that the distance from the inlet orifice of the static guide to the center of the static guide-facing side of the fiber package is in the range of 25 to 38 cm, and the distance (R) between the centers of the static guide-facing sides of the fiber package and standby package is in the range of 25 to 50 cm.

5 Claims, 4 Drawing Sheets

UNWINDING MACHINE FOR ELASTROMERIC FIBER USING OETO METHOD

FIELD OF THE INVENTION

The present invention relates to an over-end-take-off (OETO) device and a method for unwinding an elastomeric fiber.

BACKGROUND OF THE INVENTION

Due to its high cohesive force, an elastomeric fiber such as a polyurethane fiber displays large variations in the frictional forces and tension levels as it is unwound from a cylindrical mandrel (package). Thus, the fraction of the fiber unwound from the outer layer region of the package displays significantly different properties from those unwound from the inner layer region of the package, leading to a non-uniform final product. In other words, there has been the problem that the properties of an elastomeric fiber depend on the winding region of its package.

In order to solve the aforementioned problem, there has been reported a technique to rewind an elastomeric fiber unwound from the package. However, this approach requires an additional rewinding process, resulting in poor productivity and a high manufacturing cost.

U.S. Pat. No. 6,676,054 discloses a method for unwinding a fiber comprising controlling the distance from a fiber package to a fiber guide depending on the tack level of the fiber. Specifically, the distance is equal to at least 41 cm for a fiber with tack of 2 g or more, and 71 to 91 cm for a fiber with tack of 7.5 g or more. However, this method has problems in that the distance must be intermittently and cumbersomely manipulated whenever the tack value varies, which causes poor productivity.

In addition, there has been employed a method for preparing an elastomeric fiber having low tack by way of adding to the starting polymeric resin of an elastomeric fiber an anti-tack agent, e.g., a metal salt of a fatty acid such as magnesium stearate, calcium stearate and sodium stearate, followed by spinning the resulting resin. However, the spun elastomeric fiber obtained by this method suffers from the problem of frequent filament cuts due to a ballooning phenomenon when subjected to be downward unwound.

Accordingly, there has been a need to develop an improved unwinding device which is suitable for unwinding an elastomeric fiber having an anti-tack agent incorporated therein.

SUMMARY OF THE INVENTION

Accordingly, it is an object of the present invention to provide a space-saving OETO-type unwinding device which can easily unwind an elastomeric fiber from a package without generating undesirably large tension variations and filament cuts.

It is another object of the present invention to provide a method for unwinding an elastomeric fiber using said device.

In accordance with one aspect of the present invention, there is provided an OETO (over-end-take-off) unwinding device for an elastomeric fiber which comprises:

(A) a frame, (B) a fiber package and a standby package which are affixed to said frame by a package holder, (C) a driven take-off roll for unwinding the fiber from the fiber package, and (D) a static guide having an orifice for guiding the fiber unwound from the fiber package to the driven take-off roll, said static guide disposed on the frame such that the distance (d) from the inlet orifice of the static guide to the center of the static guide-facing side of the fiber package is in the range of 25 to 38 cm, and the distance (R) between the centers of the static guide-facing sides of the fiber package and standby package is in the range of 25 to 50 cm.

BRIEF DESCRIPTION OF THE DRAWINGS

The above and other objects and features of the present invention will become apparent from the following description of the invention, when taken in conjunction with the accompanying drawings, which respectively show.

| | |
|---|---|
| 1: standby package | 2: package holder |
| 3: fiber connecting a fiber package and a standby package | |
| 4: fiber package | |
| 5: fiber unwound from a fiber package | |
| 6: static guide | 7: roller guide |
| 8: driven take-off roll | 9: take-up roll |
| 10: tensiometer | 100: frame |
| 20: a magnetic tensioner | |

DETAILED DESCRIPTION OF THE INVENTION

Figure 1:
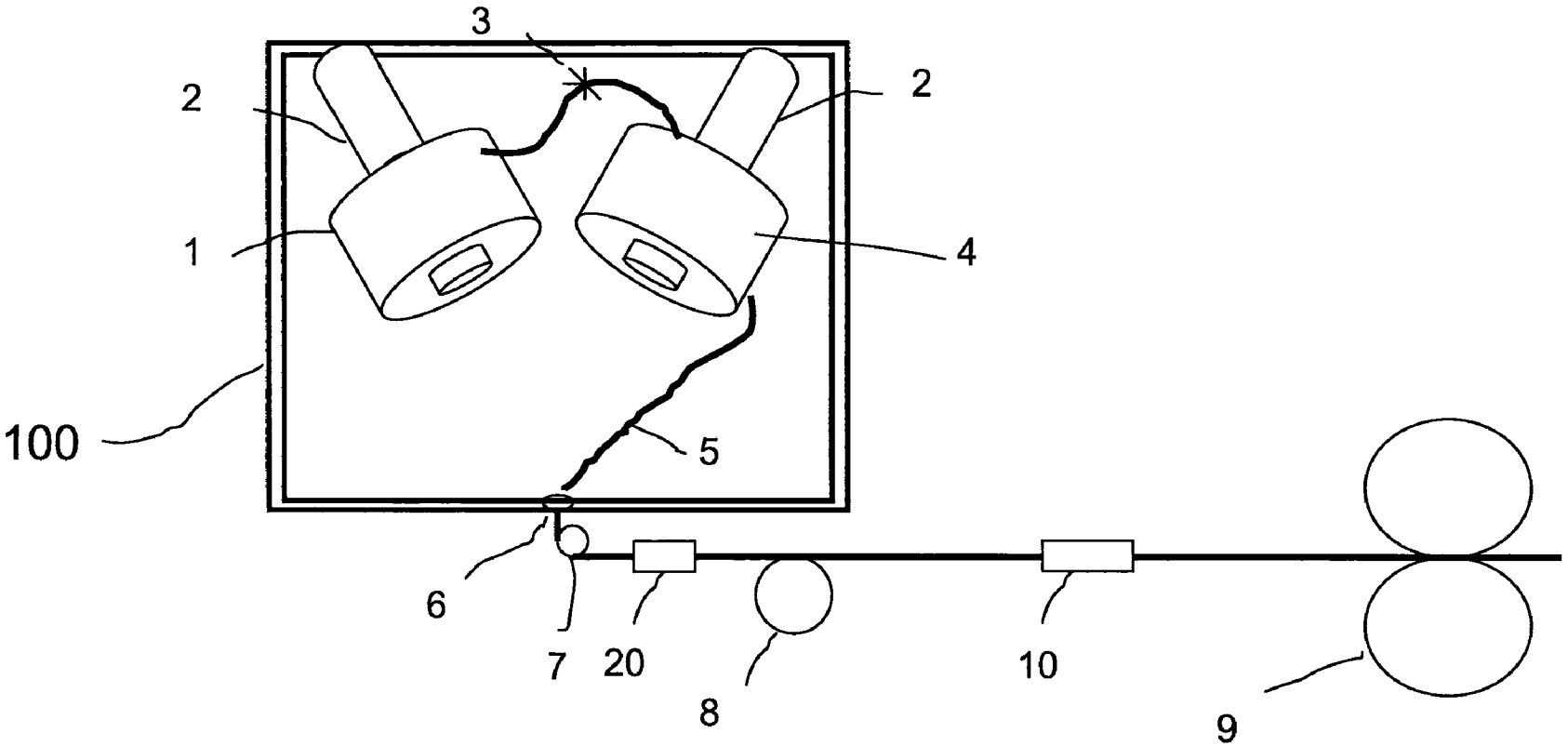
FIG. 1: a schematic diagram of an OETO unwinding device in accordance with the present invention.

FIG. 1 illustrates a schematic diagram of the OETO unwinding device for an elastomeric fiber in accordance with the present invention. With reference to FIG. 1, standby package (1) and fiber package (4), which are connected to each other by fiber (3) (an elastomeric fiber), are positioned according to a pre-determined configuration by package holders (2) affixed to frame (100). The fiber (5) unwound from the fiber package (4) is then directed, in sequence, through static guide (6) having an orifice, optional roller guide (7) around which the fiber is bent at an angle of about 90°, driven take-off roll (8), optional several roller guides (not shown in FIG. 1), tensiometer (10) and take-up roll (9).

The static guide (6) is typically an orifice whose inner surface is made of a ceramic material which exhibits excellent wear resistance and low friction. For the purpose of minimizing the space which the inventive unwinding device occupies, the roller guide (7) guides the fiber coming out through the static guide (6) to move at a right angle around the frame. The inventive unwinding device may further include between the roller guide (7) and driven take-off roll (8) a roller-type magnetic tensioner which helps to prevent filament cuts by a ballooning phenomenon generated by downward unwinding the fiber from the package. The driven take-off roll (8) is rotated at a conventional rate used in various unwinding processes, and the rate may be adjusted depending on the tension level of the fiber or the desired draw ratio. The take-up roll (9) may be positioned inside the unwinding device as a part thereof and is usually rotated at a rate higher than that of the driven take-off roll (8) so as to provide the desired draft. The inventive unwinding device may her include various forms of several roller guides between the driven take-off roll (8) and take-up roll (9) so as to accomplish the desired fineness.

The elastomeric fiber used in the inventive unwinding device may be obtained by adding to a polyurethane polymer an anti-tack agent, e.g., metal salts of fatty acids such as magnesium stearate, calcium stearate, sodium stearate and a mixture thereof, followed by spinning the resulting mixture. The polyurethane polymer may be prepared by reacting an organic diisocyanate component and a polymeric diol component to form a polyurethane precursor, and subjecting the polyurethane precursor to a reaction with diamine for chain elongation and monoamine for chain termination in an organic solvent.

Representative examples of the organic diisocyanate component used in the present invention include diphenylmethane-4,4'-diisocyanate, hexamethylene diisocyanate, toluene diisocyanate, butylene diisocyanate, hydrogenated P,P-methylene diisocyanate and a mixture thereof. Representative examples of the polymeric diol component used in the present invention include a polytetramethylene ether glycol, polypropylene glycol, polycarbonate diol and a mixture thereof. Diamines suitable for use in the present invention may be ethylene diamine, propylene diamine, hydrazine and a mixture thereof, and as the monoamine, diethylamine, monoethanolamine, dimethylamine and a mixture thereof may be employed. If necessary, various additives including a UV stabilizer, antioxidant, $NO_x$ gas, yellowing inhibiting agent, fixation enhancing agent and chlorine resistant agent may be added to the polyurethane polymer for property enhancement.

The anti-tack agent may be used in an amount ranging from 0.05 to 5 wt % based on the weight of the polymer. In particular, the elastomeric fiber used in the preparation of a diaper necessarily contains such an anti-tack agent.

Figure 2:
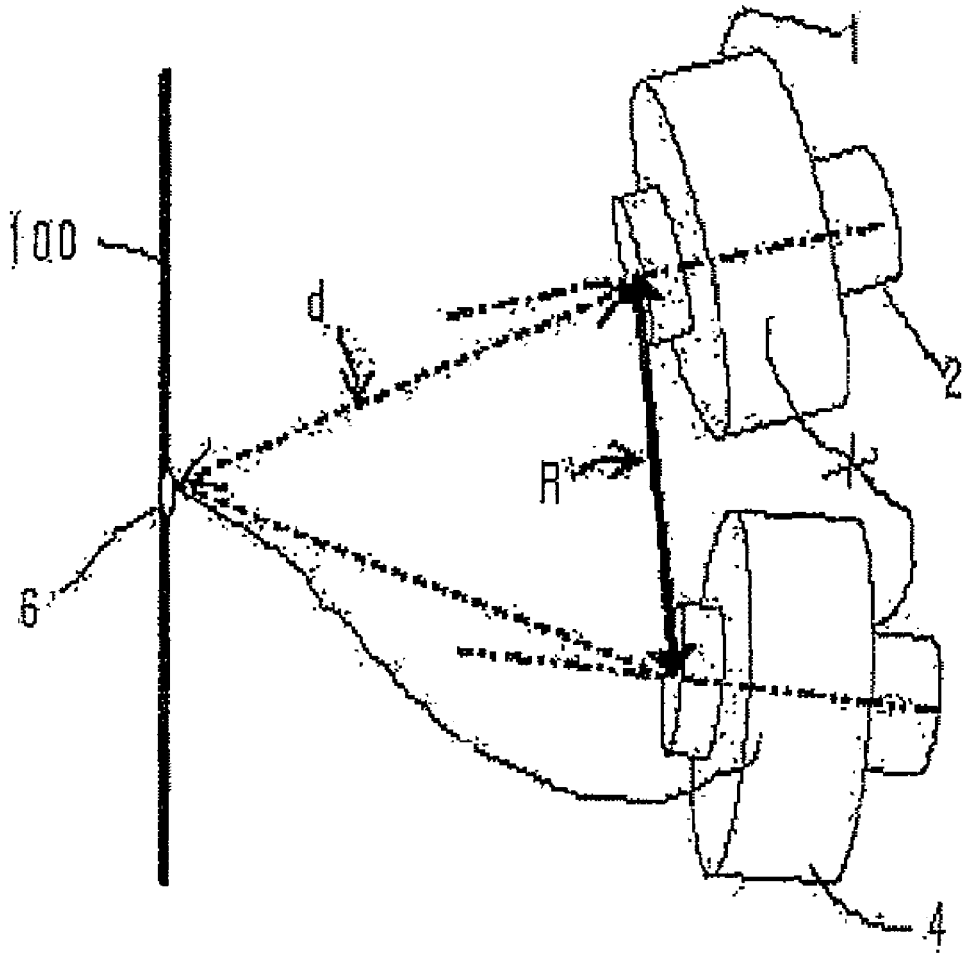
FIG. 2: a schematic diagram illustrating a distance (d) between a static guide (6) and a fiber package (4), and a distance (R) between a fiber package (4) and a standby package (1)

As previously mentioned, the standby package (1) and the fiber package (4) are affixed to the frame (100) by the package holder (2), wherein the distance (d) between the static guide (6) and the fiber package (4) as shown in FIG. 2 is preferably in the range of 25 to 38 cm, more preferably of 30 to 35 cm. When the distance (d) is less than 25 cm, frequent tension spikes occur due to large variations of the tension level, which leads to filament cuts. The distance (d) more than 38 cm lowers space efficiency of the unwinding working.

In addition, the distance (R) between the centers of the corresponding sides of the fiber and standby packages facing the static guide (6) as shown in FIG. 2 is preferably in the range of 25 to 50 cm, more preferably of 30 to 40 cm. Such a specified range of the distance (R) can prevent filament cuts caused by ballooning even in a high-speed unwinding process.

Figure 3:
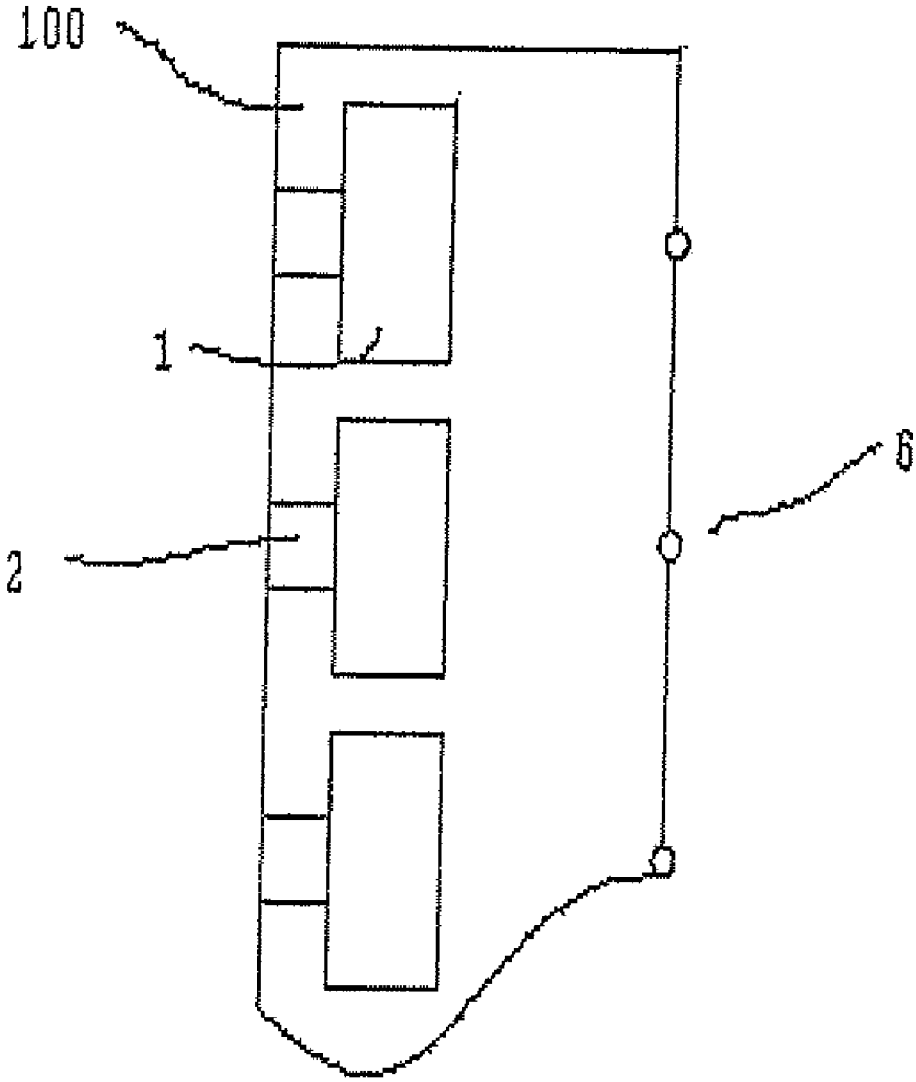
FIGS. 3 and 4: side views of one embodiment of the inventive unwinding device.
Figure 4:
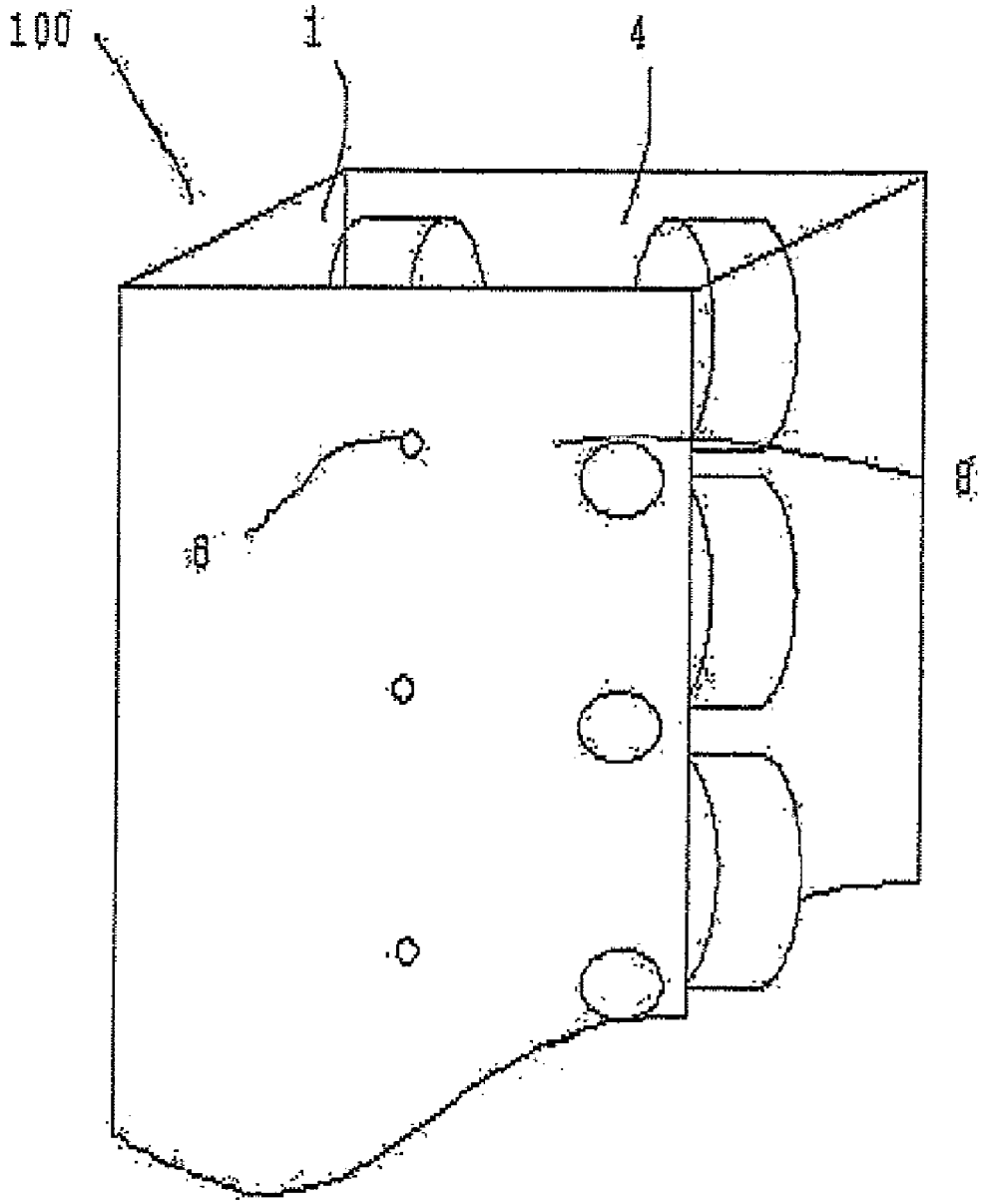

FIGS. 3 and 4 illustrate one embodiment of the inventive unwinding device. This OETO unwinding device is designed to have the capacity to feed a manufacturing line with desired number of thread lines. In case of eight thread lines, for example, the unwinding device requires the capacity to accommodate sixteen packages. Each thread line supplied from the fiber package (4) to the static guide (6) is kept in the horizontal plane. The packages are mounted in vertical tiers, each tier holding four packages. The four packages are arranged in pairs, each pair consisting of one fiber package (4) and one standby package (1).

As described above, the use of the OETO unwinding device of the present invention allows facile unwinding of an as-spun elastomeric fiber from a package without generating undesirably large tension variations and filament cuts caused by a ballooning phenomenon, thereby enhancing the productivity of the fiber manufacturing process. Further, the inventive unwinding device can be designed to occupy a minimal space.

The following Examples and Comparative Examples are given for the purpose of illustration only, and are not intended to limit the scope of the invention.

Example 1

A package of Creora® (Hyosung Corporation), an elastomeric fiber having tack of 1.85 g, was affixed to the package holder (2) of the unwinding device shown in FIG. 1. The elastomeric fiber was obtained by adding magnesium stearate as an anti-tack agent to a polyurethane polymer in an amount of 0.4 wt % based on the weight of the polymer, followed by spinning the resulting mixture. The unwinding process of the fiber package was performed using the unwinding device shown in FIG. 1. During the unwinding process, the unwinding tension level of the fiber was measured and the frequency of filament cut was counted.

The fiber (5) unwound from the fiber package (4) was directed, in sequence, through the static guide (6), the roller guide (7), the driven take-off roll (8) and the take-up roll (9). The distance (d) between the static guide (6) and the center of the static guide-facing side of the fiber package (4) was 30 cm, and the distance (R) between the centers of the static guide-facing sides of the fiber package (4) and standby package (1) was 40 cm.

The average tension value (g) of the fiber was determined over ten-minute run time using the tensiometer (10) (Rothschild tensiometer) positioned between the driven take-off roll (8) and the take-up roll (9). The speeds of the driven take-off roll (8) and the take-up roll (9) were set as 100 nm min and 400 m/min, respectively (extension rate: 300%, draw ratio: 4.0). The tension spike was determined by the frequency of the tension which deviated from the average tension value by 30 g or more.

Examples 2 to 7 and Comparative Examples 1 to 3

The procedure of Example 1 was repeated except that the distances, d and R, were controlled as shown in Table 1, to perform the fiber unwinding process.

The results obtained in Examples 1 to 7 and Comparative Examples 1 to 3 are shown in Table 1.

TABLE 1

| | Distance d (cm) | Distance R (cm) | Unwinding tension Average (g) | Variation | Spike (frequency) | Cut frequency |
|---|---|---|---|---|---|---|
| Ex. 1 | 30 | 40 | 119.6 | 5.5 | 0 | 0 |
| Ex. 2 | 25 | | 118.6 | 5.5 | 2 | 0 |
| Ex. 3 | 34 | | 112.4 | 6.4 | 0 | 0 |
| Ex. 4 | 38 | | 119.3 | 5.8 | 0 | 0 |
| C.E. 1 | 20 | | 125.5 | 7.9 | 13 | 4 |
| Ex. 5 | 30 | 25 | 114.8 | 5.8 | 1 | 0 |
| Ex. 6 | | 30 | 113.5 | 5.5 | 0 | 0 |
| Ex. 7 | | 50 | 116.5 | 5.9 | 1 | 0 |
| C.E. 2 | | 20 | 121.4 | 8.6 | 10 | 3 |
| C.E. 3 | | 60 | 128.7 | 7.9 | 5 | 2 |

As shown in Table 1, the elastomeric fiber is uniformly and easily unwound from the package without exhibiting filament cuts in Examples 1 through 7 which were performed under the conditions specified by the present invention, whereas unsatisfactory results were obtained in Comparative Examples 1 through 3.

As described above, the use of the OETO unwinding device of the present invention allows easy unwinding of an as-spun elastomeric fiber from a package with minimal tension variations and without generating undesirably filament cuts caused by a ballooning phenomenon, thereby enhancing the productivity of the fiber manufacturing process.

While the invention has been described with respect to the above specific embodiments, it should be recognized that various modifications and changes may be made to the invention by those skilled in the art which also fall within the scope of the invention as defined by the appended claims.

What is claimed is:

1. An over-end-take-off (OETO) unwinding device for an elastomeric fiber which comprises:

(A) a frame, (B) a fiber package and a standby package which are affixed to said frame by a package holder, (C) a driven take-off roll for unwinding the fiber from the fiber package, and (D) a static guide having an orifice for guiding the fiber unwound from the fiber package to the driven take-off roll, said static guide disposed on the frame such that the distance (d) from an inlet orifice of the static guide to the center of the static guide-facing side of the fiber package is in the range of 25 to 38 cm, and the distance (R) between the centers of the static guide-facing sides of the fiber package and standby package is in the range of 25 to 50 cm wherein the elastomeric fiber includes an anti-tack agent which is added to a polyurethane polymer and formed by spinning the resulting mixture.

2. The unwinding device of claim 1, wherein a roller guide is further positioned between the static guide and the driven take-off roll.

3. The unwinding device of claim 2, wherein the roller guide is positioned such that the fiber coming out of the static guide is bent at a right angle towards the driven take-off roll.

4. The unwinding device of claim 2, wherein a magnetic tensioner is further positioned between the roller guide and the driven take-off roll.

5. The unwinding device of claim 1, wherein the anti-tack agent is a metal salt of a fatty acid selected from the group consisting of magnesium stearate, calcium stearate, sodium stearate and a mixture thereof.

* * * * *